United States Patent [19]

Gilchrist, Jr.

[11] Patent Number: 4,714,379

[45] Date of Patent: Dec. 22, 1987

[54] PIPELAY IN SLURRY TRENCH

[75] Inventor: Robert T. Gilchrist, Jr., Houston, Tex.

[73] Assignee: Shell Western E&P Inc., Houston, Tex.

[21] Appl. No.: 935,423

[22] Filed: Nov. 26, 1986

[51] Int. Cl.[4] ..... F16L 1/04; E02F 5/02

[52] U.S. Cl. ..... 405/163; 405/158; 405/166; 405/267

[58] Field of Search ..... 405/158–164, 405/267, 166

[56] References Cited

U.S. PATENT DOCUMENTS

| | | | |
|---|---|---|---|
| 1,152,326 | 8/1915 | Lewis | 405/164 |
| 1,220,188 | 3/1917 | Chapman | 405/164 |
| 3,411,307 | 11/1968 | Huitt et al. | 405/163 |
| 3,664,142 | 5/1972 | Janz | 405/163 |
| 4,114,390 | 9/1978 | Van Steveninck et al. | 405/163 |
| 4,329,083 | 5/1982 | Parkinson | 405/267 X |

FOREIGN PATENT DOCUMENTS

| | | | |
|---|---|---|---|
| 1915091 | 1/1970 | Fed. Rep. of Germany | 405/159 |

OTHER PUBLICATIONS

"Slurry Walls" by Petros P. Xanthakos, McGraw-Hill, Inc., 1979.

*Primary Examiner*—Dennis L. Taylor

[57] ABSTRACT

A deep trench is excavated into a sea bottom. The trench is filled with a slurry, e.g. clay and water, to maintain trench integrity for a period of time. A pipeline is subsequently lowered to the trench bottom by either gravity settlement, jet down using water jets, or vibration.

5 Claims, 2 Drawing Figures

PIPELAY IN SLURRY TRENCH

BACKGROUND OF THE INVENTION

In the offshore Arctic, the seafloor is subject to extensive scouring by ridges of sea ice. The ice moves through the soil with great power, particularly in waters between 60 and 140 feet deep. Pipelines must be placed in trenches below this scour activity, which may require trenches as deep as 25 feet for tracts in 100 feet of water. To construct these trenches with slopes that would stay stable for the duration of construction would require massive excavations. Such trenches are too deep for mechanical excavation shields to be practical for the full depth. Thus, the art is in need of an improved seafloor deep trenching technique.

Applicant is not aware of any prior art which, in his judgment as one skilled in the pipeline art, would anticipate or render obvious the novel technique of the present invention; however, for the purposes of fully developing the background of the invention, and establishing the state of the requisite art, the following is set forth: "Slurry Walls" by Petros P. Xanthakos, 1979, page 2.

SUMMARY OF THE INVENTION

The primary purpose of the present invention is to maintain the integrity of a seafloor trench until a pipeline can be laid thereinto. In order to accomplish this purpose the invention provides a method comprising excavating a trench in the seafloor; filling the trench with a slurry to prevent walls of the trench from collapsing; and laying the pipeline into the trench. Preferably, the slurry comprises up to about 50 wt% local clay or silt, up to about 10 wt% bentonite, and up to about 0.1 wt% polysaccharide such as carboxymethyl cellulose. More preferably, the slurry is reused in further trenching after the pipeline is laid.

Other purposes, distinctions over the art, advantages and features of the invention will be apparent to one skilled in the art upon review of the following.

DESCRIPTION OF PREFERRED EMBODIMENTS

A key concept of the present process is that vertical or near-vertical trench walls on the seafloor can be maintained using slurries, preferably sea water slurries comprised almost entirely of local clays. Trench excavation and pipelaying can be broken down into a series of sequential phases: excavation/slurry backfill; pipelay; and pipe lowering. The phases may be decoupled or accomplished using a single vessel.

Figure 1:
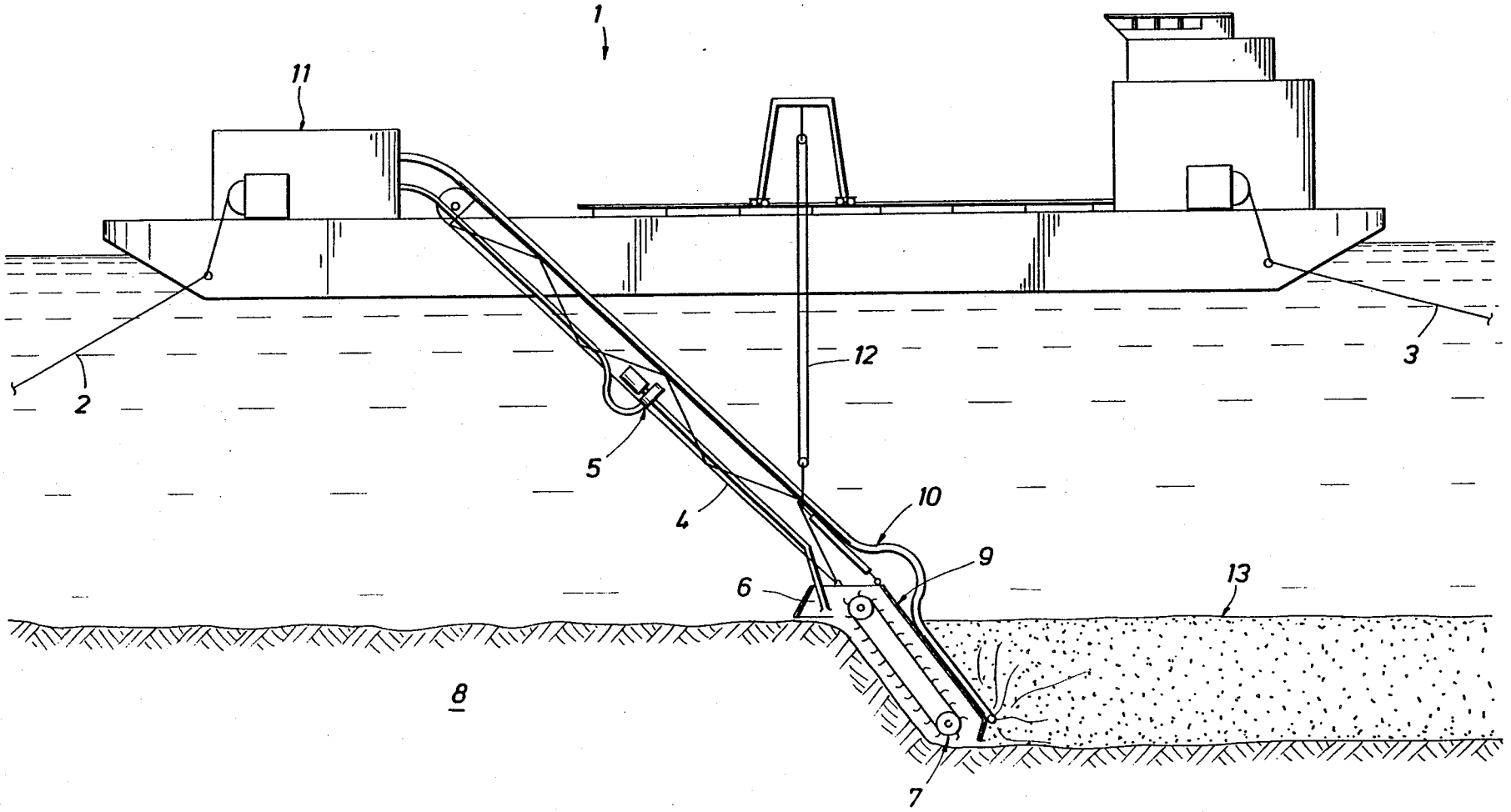
FIG. 1 discloses an excavation and backfill process.

The first phase is to excavate a trench, for example about 6 feet wide, to an appropriate depth, as shown in FIG. 1. A vessel 1, anchored with anchor cables 2 and 3, or dynamically positioned, is employed above an area where it is desired to locate a trench 13 and eventually lay a pipeline. A ladder 4 is deployed from the vessel and supports a pump 5 and an eductor 6 which is connected to a bucket chain excavator 7 deployed into the seabottom 8. A shroud 9 extends upwardly and supports a slurry pipeline 10 which connects to a slurry processor 11 onboard the vessel. The ladder 4 is deployed by means of a crane and winch 12 from the vessel. The bucket chain type cutter 7 is preferred for this use but other apparatus may be used. It is desirable, but not essential, to isolate the excavation phase from the subsequent backfill phase to prevent waste or contamination of slurry. In the case of a bucket chain excavator, the isolation is provided by the shroud 9 between the completed trench 13 and the excavator 7. The excavation cuttings are handled in several ways: (1) if the cuttings are of a suitable clay composition, they are transported to the surface for processing into slurry; (2) if the cuttings are to be disposed of off location, they are transported to the surface and loaded on another vessel for transport to an appropriate dump site; (3) if the cuttings are to be discarded, they are jetted or mechanically pushed out of the path of the excavator.

Directly behind the excavation process, the trench is backfilled with a suitable clay slurry. The function of this slurry is to keep the trench walls from collapsing before installing the pipeline. This is accomplished by utilizing slurry hydrostatic pressure to balance the active earth pressure of the excavation wall, and by utilizing slurry gel strength to communicate balancing earth pressures from opposite sides of the excavation. The slurry material is preferably produced from local clays treated to optimize colloidal stability, density, viscosity, and gel strength. It is preferred to use a water/clay mixture, either plain or upgraded with bentonite or other materials. The bulk of the slurry material is almost certainly available near most trench locations in the Arctic. Higher proportions of naturally occurring clays tend to build slurries of higher gel strength. This is good from the point of view of maintaining trench stability. Sea water also tends to build gel strength of slurry by virtue of flocculation structure within the slurry matrix.

Various additives cause dramatic changes in slurry properties at low concentrations. Slurries of up to about 50 wt% clay or silt with up to about 10 wt% bentonite are preferred. Polymer additives improve colloidal stability and reduce requirements for bentonite. For example, a polysaccharide such as sodium carboxymethyl cellulose or polyacrylamide can be added to control viscosity and flocculation, preferably in an amount up to about 0.1 wt%. If slurry is to be re-used, or if slurry is to be displaced with concrete and rebar properly embedded, slurry properties must fall within a more selective range than otherwise. The range of acceptable slurry properties is wider for pipeline trenching. Complete displacement of slurry is not required in the present invention.

Figure 2:
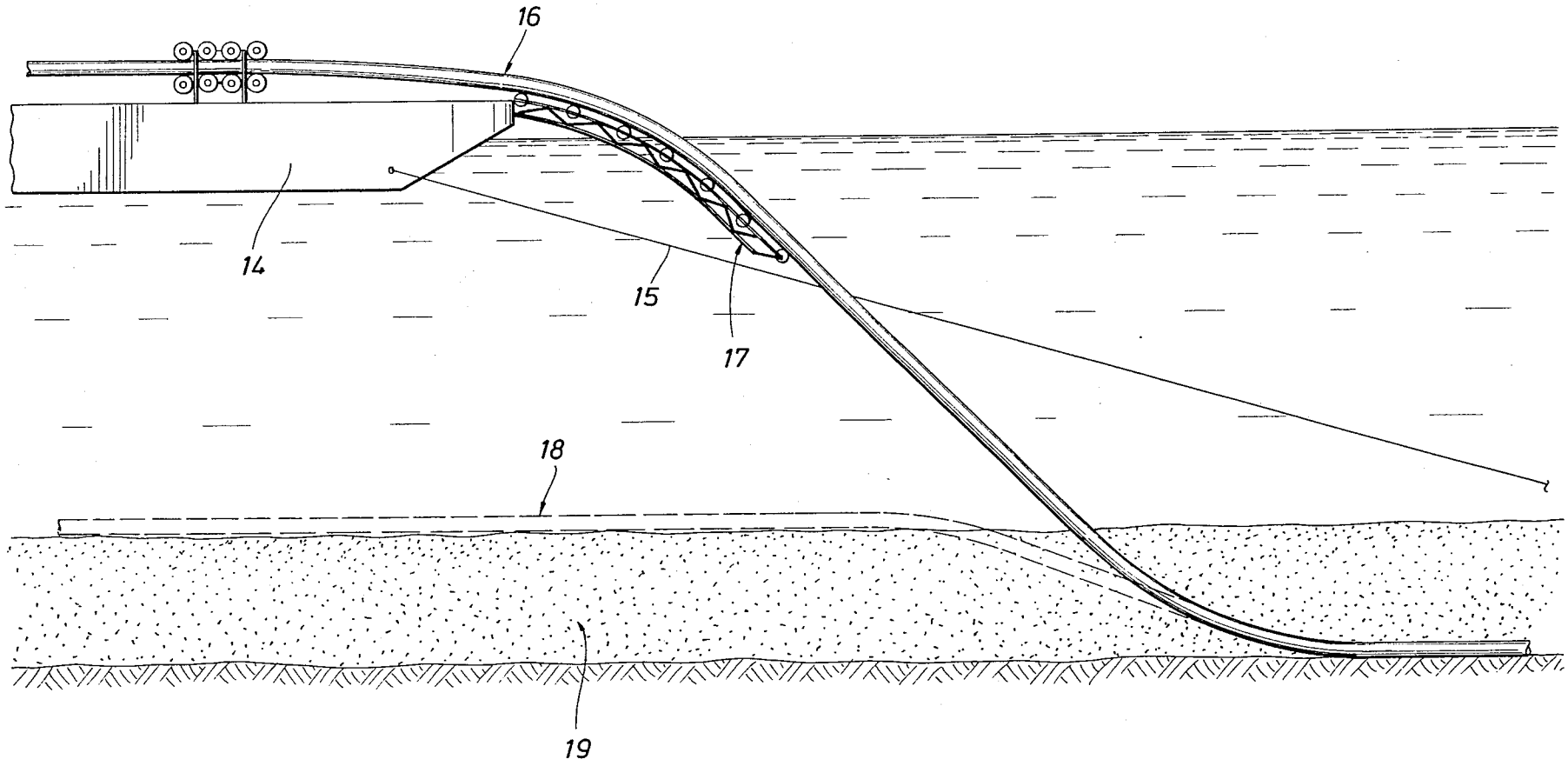
FIG. 2 discloses pipeline lowering profiles.

Pipeline lowering profiles are shown in FIG. 2. The pipeline is laid precisely on the surface of the slurry filled trench. This is accomplished using a conventional lay barge assembly line process with stinger and tensioners to maintain correct pipe geometry. Lay barge 14 is anchored with an anchor wire 15, or dynamically positioned, and is utilized to lay a pipeline 16 by means of stinger 17 extending out from the barge. The geometry for a prelaid pipeline is shown in phantom lines 18 lying just above the slurry filled trench 19. The pipeline 16 may be lowered through the slurry by means such as gravity, jetting, and vibration. The method for lowering the pipeline through the slurry may be chosen to accomodate stiff, heavy slurry.

Gravity settlement requires very close control of the slurry parameters. Two aspects compete: trench stability is increased by increasing slurry density and gel strength; pipe settlement is assured with low density, low viscosity and low gel strength. The pipe needs to be unusually heavy (specific gravity greater than 1.3) in order for the gravity lowering process to work. This can be provided by concrete weight coating and/or by flooding the line with water after fabrication.

To jet down a completed pipeline, a long jet rack is desirable. The distance from mud line to touchdown for a 36-inch diameter pipe starting flat on the seafloor and dropping 25 feet with the strain of 0.0025 inches per inch is 243 feet. This can be shortened to 171 feet by controlling the geometry above the mud line. A good time to take advantage of control geometry is the sag bend that occurs as the pipe is deployed from lay barge 14. The mud line to touchdown distance is further shortened by allowing greater strains.

An advantage of the jet down process is that slurry parameters do not have to be as tightly controlled. A slow draining, clay-rich slurry that can be jetted away as the pipe proceeds down works well. The slurry can be of high density and high gel strength and provide the greatest factor in safety against trench collapse.

The vibrate-down process requires an intermediate level of slurry parameter control. A relatively high gel strength is established in the slurry which is normally thixotropic. Vibration temporarily liquefies the slurry under and around the pipe as it proceeds down. The vibration is provided by an external source (not shown) or the pipe is vibrated using an internal source (not shown) as it comes off the lay vessel. In all cases the lowering process potential speed should exceed the excavation and pipelay process speeds.

The foregoing description of the invention is merely intended to be explanatory thereof, and various changes in the details of the described method and apparatus may be made within the scope of the appended claims without departing from the spirit of the invention.

What is claimed is:

1. A method for laying a pipeline offshore in the seafloor, comprising:

excavating a deep trench in the seafloor;

filling the trench with a slurry to maintain the integrity of the seafloor trench until the pipeline can be laid thereinto;

laying the pipeline on top of the slurry; and sinking the pipeline through the slurry and downwardly in the trench.

2. The method of claim 1 wherein the slurry comprises up to about 50 w% native clay or silt and up to about 10 w% bentonite, and wherein up to about 0.1 w% polysaccharide is added to the slurry to control viscosity and flocculation.

3. The method of claim 1 wherein the slurry is reused after the pipeline is laid.

4. A method for laying a pipeline offshore in the seafloor, comprising:

excavating a deep trench in the seafloor;

filling the trench with a slurry to maintain the integrity of the seafloor trench until the pipeline can be laid thereinto;

laying the pipeline on top of the slurry; and water jetting the pipeline through the slurry and downwardly in the trench.

5. A method for laying a pipeline offshore in the seafloor, comprising:

excavating a deep trench in the seafloor;

filling the trench with a slurry to maintain the integrity of the seafloor trench until the pipeline can be laid thereinto;

laying the pipeline on top of the slurry; and vibrating the pipeline through the slurry and downwardly in the trench.

* * * * *